US007038627B2

(12) United States Patent
Ikuta et al.

(10) Patent No.: US 7,038,627 B2
(45) Date of Patent: May 2, 2006

(54) SURFACE MOUNTING TYPE ANTENNA, ANTENNA APPARATUS AND RADIO COMMUNICATION APPARATUS

(75) Inventors: Takanori Ikuta, Kyoto (JP); Akinori Sato, Kyoto (JP)

(73) Assignee: Kyocera Corporation, Kyoto (JP)

( * ) Notice: Subject to any disclaimer, the term of this patent is extended or adjusted under 35 U.S.C. 154(b) by 96 days.

(21) Appl. No.: 10/877,526

(22) Filed: Jun. 25, 2004

(65) Prior Publication Data

US 2004/0263401 A1 Dec. 30, 2004

(30) Foreign Application Priority Data

Jun. 26, 2003 (JP) ..... P2003-183144

(51) Int. Cl.
*H01Q 1/24* (2006.01)

(52) U.S. Cl. ..... 343/702; 343/700 MS

(58) Field of Classification Search ..... 343/702, 343/700 MS, 873, 895, 846
See application file for complete search history.

(56) References Cited

U.S. PATENT DOCUMENTS 5,867,126 A * 2/1999 Kawahata et al. ..... 343/702
5,959,582 A * 9/1999 Kawahata et al. ... 343/700 MS
6,600,449 B1 7/2003 Onaka et al. ..... 343/700 MS
6,680,700 B1 * 1/2004 Hilgers ..... 343/700 MS
6,734,825 B1 * 5/2004 Guo et al. ..... 343/700 MS
6,803,881 B1 * 10/2004 Ishihara et al. ..... 343/700 MS

FOREIGN PATENT DOCUMENTS

JP 2002-204120 7/2002
JP 2002-314330 10/2002

* cited by examiner

*Primary Examiner*—Shih-Chao Chen
*Assistant Examiner*—Huedung X. Cao
(74) *Attorney, Agent, or Firm*—Hogan & Hartson, LLP

(57) ABSTRACT

The surface mounting type antenna includes a rectangular parallelepiped base body, a group of radiation electrodes and a feeder terminal. The group of radiation electrodes includes radiation electrodes formed on a first pair of side faces so as to extend from one end face side to another end face side thereof, and a radiation electrode formed on the one end face side of one side face of a second pair of side faces, the radiation electrode being connected to the radiation electrodes formed on the first pair of side faces. The feeder terminal is formed on a part of another side face of the first pair of side faces, the part being in a vicinity of another side face of the second pair of side faces, the feeder terminal being connected to the group of radiation electrodes.

24 Claims, 7 Drawing Sheets

SURFACE MOUNTING TYPE ANTENNA, ANTENNA APPARATUS AND RADIO COMMUNICATION APPARATUS

BACKGROUND OF THE INVENTION

1. Field of the Invention

The present invention relates to a surface mounting type antenna which is a small-sized antenna applicable to two frequencies used in a mobile communication apparatus such as a cellular phone, an antenna apparatus, and a radio communication apparatus using the surface mounting type antenna and the antenna apparatus.

2. Description of the Related Art

Reduction in size for a mobile communication apparatus such as a cellular phone has been advanced rapidly. Concerning an antenna that is a component of the mobile communication apparatus, efforts have been made to cope with the reduction in size using a surface mounting type antenna and the like. An example of a conventional surface mounting type antenna and an antenna apparatus using the surface mounting type antenna will be explained with reference to a perspective view of FIG. 4.

In FIG. 4, reference numeral 61 denotes a surface mounting type antenna, which is mounted on a mounting substrate 72 to constitute an antenna apparatus. In the surface mounting type antenna 61 shown in FIG. 4, reference numeral 66 denotes a rectangular parallelepiped base body; reference numeral 65 denotes a feeder terminal; and reference numerals 62 and 63 denote radiation electrodes. In addition, in the mounting substrate 72, reference numeral 74 denotes a feeder electrode, and reference numeral 73 denotes a ground conductor layer.

In a structure of the conventional surface mounting type antenna 61, in order to make the surface mounting type antenna 61 applicable to two frequencies by changing pitches of the radiation electrodes, that is, to allow the surface mounting type antenna 61 to cope with different two frequencies, on a side of the base body 66, a pitch of the spiral radiation electrode 63 connected to the feeder terminal 65 is made coarse, and a pitch of the spiral radiation electrode 62 connected to the radiation electrode 63 is made dense.

Such a surface mounting type antenna 61 is mounted on a surface of the mounting substrate 72 by connecting the feeder terminal 65 to the feeder electrode 74, whereby an antenna apparatus 71 applicable to two frequencies is constituted.

In addition, as an antenna applicable to two frequencies, for example, Japanese Unexamined Patent Publication JP A 2002-204120 discloses an antenna for a mobile communication terminal that is adapted to be used in plural frequency bonds including frequency bands different from a predetermined frequency band by connecting a ground capacitor to an antenna element for the predetermined frequency band to change a value of the predetermined frequency band. According to this disclosure, since a switch is never inserted in series in a transmission path for transmission and reception signals, an antenna, which can cope with plural frequencies without causing a problem of a signal transmission loss, is obtained.

Further, for example, Japanese Unexamined Patent Publication JP-A 2002-314330 discloses an antenna apparatus including: a dielectric base body; plural feeder radiation elements that are formed on a surface of the base body and has feeder electrodes and radiation electrodes; and a substrate for fixing the base body, in which a common feeding point for feeding power to the feeder radiation elements, stubs are provided so as to expand continuously from the feeding point on a surface of the substrate or on surfaces of the base body and the substrate, and the feeder electrodes of the feeder radiation elements are connected to a matching point of stubs that are decided on the basis of an effective line length of the radiation electrodes. According to this disclosure, the respective feeder radiation elements are excited at resonance frequencies that depend upon an effective line length of the radiation electrodes. In this case, the feeder electrodes of the respective feeder radiation elements are connected to the matching point of the stubs, which is an optimal stub length, for each of the feeder radiation elements. Therefore, satisfactory resonance characteristics are obtained at the respective resonance frequencies in the respective feeder radiation elements, and necessary bandwidths can be secured in frequency bands to which the respective resonance frequencies belong.

However, in the conventional surface mounting type antenna 61 shown in FIG. 4, there is a problem that, in order to match an operation frequency of the surface mounting type antenna 61 to a lower frequency f1 and a higher frequency f2 of a radio signal used in a communication system, it is necessary to adjust lengths and pitches of the spiral radiation electrodes 62 and 63, and the adjustment requires many labor hours.

In addition, there is also a problem that, when it is attempted to increase a dielectric constant of the base body 66 to reduce a size of the surface mounting type antenna 61, since an unnecessary resonance mode occurs unexpectedly between the spiral long radiation electrodes 62 and 63 and the ground conductor layer 73, and stable antenna characteristics applicable to two frequencies is not obtained, it is difficult to reduce a size of the surface mounting type antenna 61.

Further, in the antenna for a mobile communication terminal disclosed in JP-A 2002-204120, there is a problem that it is difficult to apply surface mounting to a mounting substrate.

Moreover, in the antenna apparatus disclosed in JP-A-2002 314330, there is a problem that since the radiation electrodes have a plane pattern, a size of the antenna increases, and it is difficult to reduce a size of the antenna.

SUMMARY OF THE INVENTION

The invention has been devised in order to solve the problems in the conventional techniques described above. It is an object of the invention to provide a surface mounting type antenna applicable to two frequencies with which satisfactory antenna characteristics can be obtained stably and frequency adjustment can be performed easily, and sizes of which can be reduced, and an antenna apparatus using this surface mounting type antenna.

In addition, it is an object of the invention to provide a radio communication apparatus applicable to two frequencies that includes the surface mounting type antenna and the antenna apparatus that are applicable to two frequencies.

The invention provides a surface mounting type antenna comprising:

a base body formed in a rectangular parallelepiped shape and made of a dielectric or magnetic material, the base body including a first pair of side faces opposed to each other, a pair of end faces opposed to each other and a second pair of side faces opposed to each other;

a group of radiation electrodes formed on the base body, including radiation electrodes formed on the first pair of side faces so as to extend from one end face side to another end face side thereof, and a radiation electrode formed on either one of the one end face side and the other end face side of one side face of the second pair of side faces, the radiation electrode being connected to the radiation electrodes formed on the first pair of side faces; and a feeder terminal formed on a part of either one of the first pair of side faces, the part being in a vicinity of another side face of the second pair of side faces, the feeder terminal being connected to the group of radiation electrodes.

The invention provides a surface mounting type antenna comprising:

a base body formed in a rectangular parallelepiped shape and made of a dielectric or magnetic material, the base body including a first pair of side faces opposed to each other, a pair of end faces opposed to each other and a second pair of side faces opposed to each other;

a group of radiation electrodes formed on the base body, including radiation electrodes formed on the first pair of side faces so as to extend from one end face side to another end face side thereof, and a radiation electrode formed on either one of the one end face side and the other end face side of one side face of the second pair of side faces, the radiation electrode being connected to the radiation electrodes formed on the first pair of side faces; and a feeder terminal formed on a part of either one of the first pair of side faces, the part being in a vicinity of the one side face of the second pair of side faces, the feeder terminal being connected to the group of radiation electrodes.

In the invention, a recess or a through hole is provided extending from the other side face toward the one side face of the second pair of side faces of the base body.

In the invention, the base body is made of a dielectric material and a relative dielectric constant thereof $\epsilon_1$ is in a range of 3 to 30.

In the invention, the base body is made of a magnetic material and a relative permeability thereof $\mu_r$ is in a range of 1 to 8.

According to the invention, since the radiation electrodes of a short double resonance pattern are formed on the first pair of side faces of the base body, a small-sized surface mounting type antenna applicable to two frequencies can be realized because of a wavelength reduction action due to a dielectric constant or a relative permeability while avoiding unnecessary resonance due to the dielectric constant or the relative permeability.

According to the invention, when the recess or the through hole is provided extending from the other side face toward the one side face of the second pair of side faces of the base body, since the base body can be reduced in weight while maintaining antenna characteristics, reliability on a mounting strength against an impact or the like after mounting can be improved.

According to the invention, an effective length of the radiation electrode becomes long and a region of the high electric current density in electric current distribution increases, so that it is possible to increase an amount of radio waves radiated from the group of radiation electrodes, and it is possible to increase gain of the antenna. Moreover, it is possible to miniaturize the antenna.

According to the invention, the impedance of the radiation electrode becomes large, so that it is possible to decrease Q of the antenna and widen the bandwidth.

The invention provides an antenna apparatus comprising:

a mounting substrate on a surface of which a feeder electrode and a ground conductor layer arranged on one side with respect to the feeder electrode are formed; and the aforementioned surface mounting type antenna, wherein the surface mounting type antenna is mounted on another side with respect to the feeder electrode in a state where either one of the first pair of side faces on which the feeder terminal is formed, faces the surface of the mounting substrate, and the feeder terminal is connected to the feeder electrode.

The invention provides an antenna apparatus comprising:

a mounting substrate on a surface of which a feeder electrode and a ground conductor layer arranged on one side with respect to the feeder electrode are formed; and the aforementioned surface mounting type antenna, wherein the surface mounting type antenna is mounted on another side with respect to the feeder electrode in a state where the other side face of the second pair of side faces faces the surface of the mounting substrate, and the feeder terminal is connected to the feeder electrode.

The invention provides an antenna apparatus comprising:

a mounting substrate on a surface of which a feeder electrode and a ground conductor layer arranged on one side with respect to the feeder electrode are formed; and the aforementioned surface mounting type antenna, wherein the surface mounting type antenna is mounted on another side with respect to the feeder electrode in a state where the one side face of the second pair of side faces faces the surface of the mounting substrate, and the feeder terminal is connected to the feeder electrode.

According to the invention, since plural resonances can be generated when power is fed to the group of radiation electrodes, which consists of opposed parts and a part connecting the opposed parts, from a feeding point. Therefore, the group of radiation electrodes can be caused to cope with a frequency f2 on a side where the feeder terminal is connected, of parts of the radiation electrodes formed on the first pair of side faces and to cope with a frequency f1 (usually, f1 is smaller than f2) different from f2 on an opposite side which is connected across the second pair of side faces, of the part of the radiation electrodes formed on the first pair of side faces to be operated as an antenna of ¼ wavelength, respectively, and operate as a surface mounting type antenna applicable to two frequencies satisfactorily.

In this case, for example, when it is desired to further decrease the frequency f1 and further increases the frequency f2, a connection point of the feeder terminal with the radiation electrodes are dislocated to either one side of the opposed end faces with respect to the group of radiation electrodes, whereby lengths of the parts of the radiation electrodes corresponding to the respective frequencies f1 and f2 can be changed. Consequently, the antenna apparatus can be caused to cope with desired two frequencies.

In addition, in the antenna apparatuses of the invention, a mean frequency of both the frequencies f1 and f2 can be decreased by increasing the dielectric constant and the relative permeability of the base body of the surface mounting type antennas. Further, the means frequency of both the frequencies f1 and f2 can be controlled to be high or low by, for example, inserting a reactance element in series in the feeder electrode on the mounting substrate.

The invention provides a radio communication apparatus comprising:

the aforementioned surface mounting type antenna or the aforementioned antenna apparatus; and at least one of a transmission circuit and a reception circuit, which cope with radio signals of different two frequency bands, connected thereto.

According to the invention, the radio communication apparatus includes the surface mounting type antenna of the invention or the antenna apparatus of the invention and at least one of the transmission circuit and the reception circuit, which cope with radio signals of different two frequency bands, connected thereto. Therefore, a small-sized and high performance radio communication apparatus applicable to two frequencies, which is capable of coping with two frequencies with one surface mounting type antenna or antenna apparatus, is obtained.

According to the invention, the radio communication apparatus includes the surface mounting type antenna of the invention or the antenna apparatus of the invention and at least one of the transmission circuit and the reception circuit applicable to two frequencies. Therefore, the radio communication apparatus has satisfactory antenna characteristics for both the two frequencies and can perform satisfactory radio communication applicable to two frequencies.

As described above, according to the invention, it is possible to provide a surface mounting type antenna applicable to two frequencies with which satisfactory antenna characteristics can be obtained stably and frequency adjustment can be performed easily, and a size of which can be reduced, and an antenna apparatus using this surface mounting type antenna. In addition, it is possible to provide a radio communication apparatus applicable to two frequencies including the surface mounting type antenna and the antenna apparatus applicable to two frequencies.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
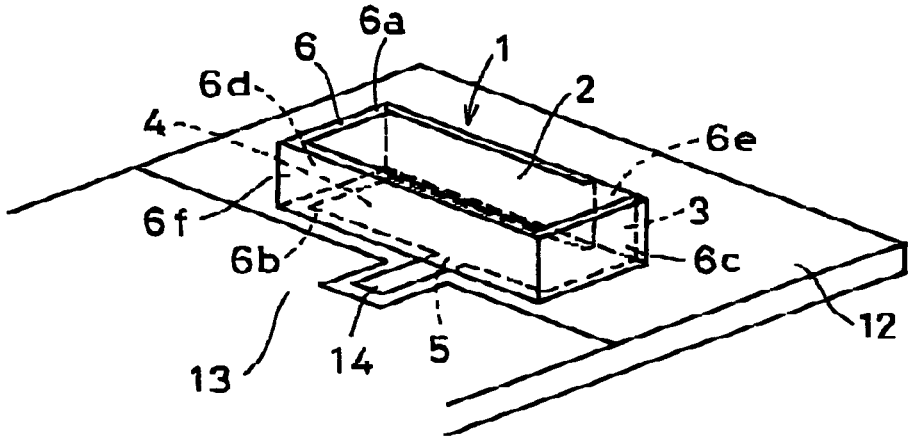
FIG. 1A is a perspective view showing a surface mounting type antenna according to a first embodiment of the invention and an antenna apparatus according to a first embodiment of the invention using the surface mounting type antenna.

Now referring to the drawings, preferred embodiments of the invention are described below.

Embodiments of a surface mounting type antenna, an antenna apparatus, and a radio communication apparatus of the invention will be hereinafter explained with reference to the accompanying drawings.

Figure 1B:
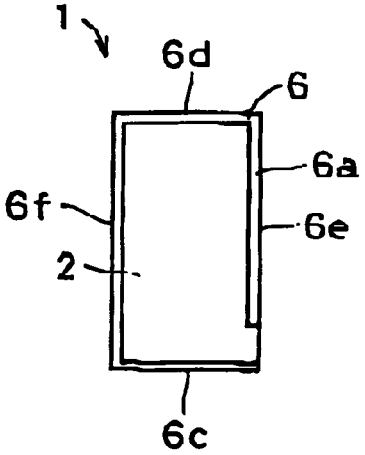
FIG. 1B is a plan view of the surface mounting type antenna shown in FIG. 1A.
Figure 1C:
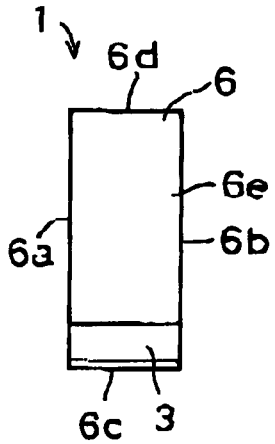
FIG. 1C is a right side view of the surface mounting type antenna shown in FIG. 1A.
Figure 1D:
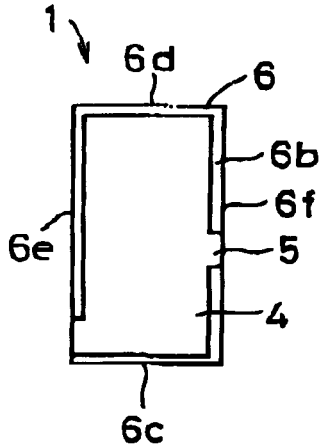
FIG. 1D is a bottom plan view of the surface mounting type antenna shown in FIG. 1A.

FIG. 1A is a perspective view showing a surface mounting type antenna according to a first embodiment of the invention and an antenna apparatus according to a first embodiment of the invention constituted by mounting the surface mounting type antenna on a surface of a mounting substrate. FIG. 1B is a plan view of the surface mounting type antenna shown in FIG. 1A. FIG. 1C is a right side view of the surface mounting type antenna shown in FIG. 1A. FIG. 1D is a bottom plan view of the surface mounting type antenna shown in FIG. 1A.

A surface mounting type antenna 1 according to the first embodiment of the invention includes a base body 6, a first radiation electrode 2, a second radiation electrode 4, a third radiation electrode 3 and a feeder terminal 5. The base body 6 is made of dielectric or magnetic material and is formed in a rectangular parallelepiped shape. The base body 6 includes a first pair of side faces 6*a* and 6*b* opposed to each other, a pair of end faces 6*c* and 6*d* opposed to each other and a second pair of side faces 6*e* and 6*f* opposed to each other. The first radiation electrode 2 is formed on one side face (i.e., an upper face of the base body 6 in FIG. 1A) 6*a* of the first pair of side faces 6*a* and 6*b* so as to extend from one end face 6*c* side to another end face 6*c* side thereof. The second radiation electrode 4 is formed on another side face (i.e., a lower face of the base body 6 in FIG. 1A) 6*b* of the first pair of side faces 6*a* and 6*b* so as to extend from the one end face 6*c* side to the other side face 6*d* side thereof. The third radiation electrode 3 is formed on the one end face (i.e., an end face on a near side of the base body 6 in FIG. 1A) 6*c* side of one side face (i.e., a side face on a far side of the base body 6 in FIG. 1A) 6*e* of the second pair of side faces 6*e* and 6*f*. The third radiation electrode 3 is connected to the first and second radiation electrodes 2 and 3. The feeder terminal 5 is formed on a part of the other side face 6*b* of the first pair of side faces 6*a* and 6*b*. The part is a vicinity of another side face (i.e., a side face on the near side of the base body 6 in FIG. 1A) 6*f* of the second pair of side faces 6*e* and 6*f*. The feeder terminal 5 is connected to the second radiation electrode 4.

In the surface mounting type antenna 1 according to the first embodiment of the invention, on the rectangular parallelepiped base body 6, a group of radiation electrodes 2, 3 and 4 including the radiation electrodes 2, 4 formed on the first pair of side faces 6*a* and 6*b* so as to extend from the one end face 6*c* side to the other end face 6*d* side thereof, and the radiation electrode 3 formed on either one of the one end face 6*c* side and the other end face 6*d* side of the one side face 6*e* of the second pair of side faces 6*e* and 6*f*, the radiation electrode 3 being connected to the radiation electrodes 2 and 4 formed on the first pair of side faces 6*a* and 6*b*, and the feeder terminal 5 formed on a part of either one of the first pair of side faces 6*a* and 6*b*, the part being in a vicinity of the other side face 6*f* of the second pair of side faces 6*e* and 6*f*, the feeder terminal 5 being connected to the radiation electrode 4, are provided.

An antenna apparatus according to the first embodiment of the invention includes the surface mounting type antenna 1 and a mounting substrate 12. On a surface of the mounting substrate 12, a feeder electrode 14 and a ground conductor layer 13 arranged on one side (i.e., a left near side of an upper face of the mounting substrate 12 in FIG. 1A) with respect to the feeder electrode 14 are formed.

The surface mounting type antenna 1 according to the first embodiment of the invention is mounted on this mounting substrate 12 on another side (i.e., a right far side of the upper face of the mounting substrate 12 in FIG. 1A) with respect to the feeder electrode 14 in a state where a side face (i.e., the lower face of the base body 6 in FIG. 1A) 6*b* of the first pair of side faces 6*a* and 6*b* of the base body 6 on which the feeder terminal 5 is formed, faces the surface of the mounting substrate 12, and the feeder terminal 5 is connected to the feeder electrode 14. In this way, the antenna apparatus according to the first embodiment of the invention is constituted.

According to the surface mounting type antenna 1 according to the first embodiment of the invention, a ¼ wavelength monopole antenna coping with a higher frequency f2 of radio signals of two frequency bands used in a communication system is formed by a part of the second radiation electrode 4 formed on the other side face (i.e., the lower face of the base body 6 in FIG. 1A) 6*b* of the first pair of side faces 6*a* and 6*b* of the base body 6 to which the second radiation electrode the feeder terminal 5 is connected. Consequently, the radiation electrode 4 can operate as an antenna coping with the frequency f2.

Moreover, a ¼ wavelength monopole antenna coping with a lower frequency f1 of the radio signals of the two frequency bands is formed by a part of the first radiation electrode 2 formed on the one side face (i.e., the upper face of the base body 6 in FIG. 1A) 6*a* of the first pair of side faces 6*a* and 6*b* of the base body 6 which first radiation electrode is connected to the second radiation electrode 4 through the third radiation electrode 3. Consequently, the first radiation electrode 2 can operate also as an antenna coping with the frequency f1. Therefore, according to the surface mounting type antenna 1 according to the first embodiment of the invention and the antenna apparatus according to the first embodiment of the invention using this surface mounting type antenna 1, it is possible to function as an antenna applicable to two frequencies having satisfactory antenna characteristics.

Figure 5:
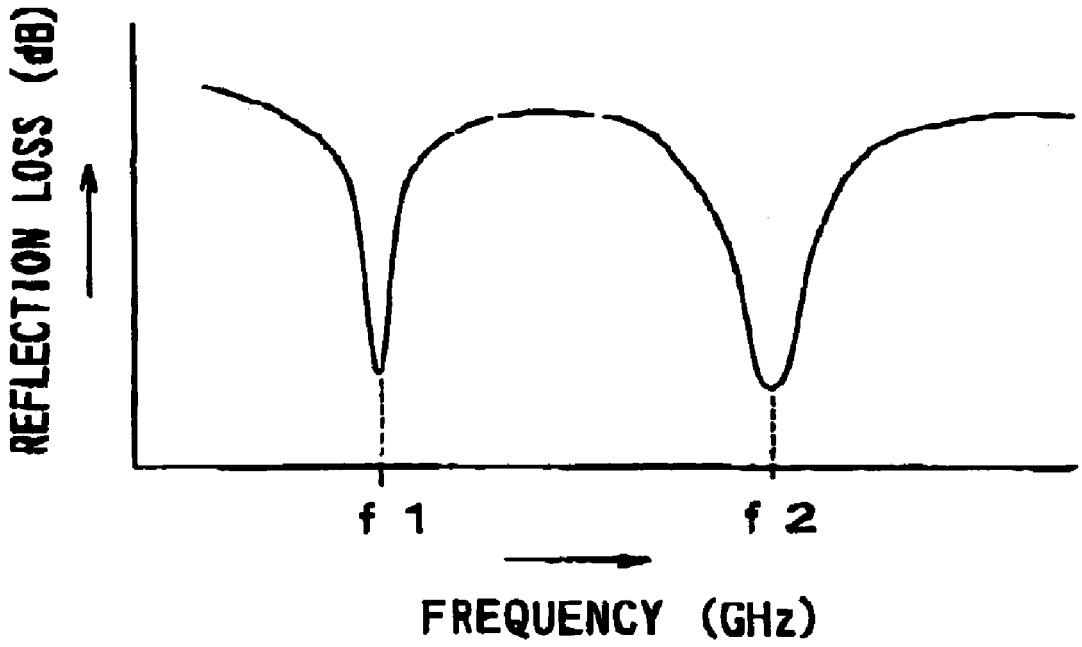
FIG. 5 is a diagram showing an example of frequency characteristics of a reflection loss in the antenna apparatus of the invention.

FIG. 5 is a diagram showing frequency characteristics of a reflection loss indicated by the antenna apparatus according to the first embodiment of the invention. In FIG. 5, a horizontal axis represents a frequency (unit: GHz), a vertical axis represents a reflection loss (unit: dB), and a characteristic curve indicates frequency characteristics of the reflection loss. As it is seen in this figure, the antenna apparatus according to the first embodiment of the invention operates as an antenna applicable to two frequencies that copes with the different frequencies f1 and f2. Note that antenna apparatuses according to the second and third embodiments of the invention to be described later have the same characteristics.

In the surface mounting type antenna 1 according to the first embodiment of the invention, if a distance between the first pair of side faces 6*a* and 6*b* is too short, bonding by a current between the first radiation electrode 2 and the second radiation electrode 4, which are formed on the first pair of side faces 6*a* and 6*b*, respectively, becomes strong, whereby currents in opposite directions flow in the radiation electrodes 2 and 4, and both radiation electrodes 2 and 4 operate less easily. Therefore, it is desirable to secure an interval as long as possible between the first radiation electrode 2 and the second radiation electrode 4 opposed to each other. For example, in the case of an antenna coping with two frequencies of 800 MHz and 1900 MHz, it is preferable that the interval between the first radiation electrode 2 and the second radiation electrode 4 is 3 mm or more.

In addition, in the surface mounting type antenna 1 according to the first embodiment of the invention, when a width of the first radiation electrode 2 and the second radiation electrode 4, which are formed on the first pair of side faces 6*a* and 6*b*, respectively, (a size in a direction directed between the second pair of side faces 6*e* and 6*f* of the base body 6) is reduced, bandwidths of the respective radiation electrodes are reduced. Moreover, when a length of the first radiation electrode 2 and the second radiation electrode 4 (a size in a direction directed between the opposed pair of end faces 6*c* and 6*d* of the base body 6) is reduced, the bandwidths tend to be reduced. Therefore, it is preferable that the first and second radiation electrodes 2 and 4 extend to the end of the base body 6 in a shape as wide as possible.

Further, in the antenna apparatus according to the first embodiment of the invention, when the surface mounting type antenna 1 according to the first embodiment of the invention is mounted on the mounting substrate 12, if a distance between the first and second radiation electrodes 2 and 4 and the ground conductor layer 13 of the mounting substrate 12 is too short, bandwidths of the respective radiation electrodes are reduced. Considering this point, it is necessary to optimize the width and the length of the first and second radiation electrodes 2 and 4 and the distance between the first and second radiation electrodes 2 and 4 and the ground conductor layer 13.

Moreover, in the antenna apparatus according to the first embodiment of the invention, concerning a connection position of the feeder terminal 5 connected to the second radiation electrode 4, a distance from closer one of the pair of end faces 6*c* and 6*d* of the base body 6 to the feeder terminal 5 is changed, whereby a length from the feeder terminal 5 to the end of the second radiation electrode 4 and a length from the feeder terminal 5 to the end of the first radiation electrode 2 are changed. Consequently, it is possible to perform frequency adjustment. For example, when the connection position of the feeder terminal 5 is set closer to the end of the second radiation electrode 4, the length from the feeder terminal 5 to the end of the second radiation electrode 4 is reduced, whereby the frequency f2 increases. On the other hand, the distance from the feeder terminal 5 to the end of the first radiation electrode 2 is increased, whereby the frequency f1 decreases. Moreover, it is also possible to perform frequency adjustment by connecting a reactance element, for example, a chip inductor to the feeder electrode 14 in series.

It is assumed that the surface mounting type antenna 1 according to the first embodiment of the invention has the following dimensions. For example, the base body 6 has a dielectric constant of 6.7, a length of 35 mm, a distance between the first pair of side faces 6*a* and 6*b* of 5 mm, and a distance between the second pair of side faces 6*c* and 6*f* of 5 mm. The first radiation electrode 2 has a length of 34 mm and a width of 4 mm. The second radiation electrode 4 has a length of 34 mm and a width of 4 mm. The third radiation electrode 3 is arranged in a position 11 mm from the one end face 6*c* of the opposed pair of end faces 6*c* and 6*d* and has a width of 3 mm. The feeder terminal 5 is arranged in a position 15 mm from the one end face 6*c* of the opposed pair of end faces 6*c* and 6*d*. The surface mounting type antenna 1 is mounted on the surface of the mounting substrate 12 in a state where the second radiation electrode 4 faces the surface of the mounting substrate and a distance of 5 mm from the ground conductor layer 13, which has a size of 40×80 mm, to the second radiation electrode 4 is kept. In this case, it is possible to obtain an antenna applicable to two frequencies that copes with CDMA (frequency band: 824 to 894 MHz) in the part of the first radiation electrode 2 and copes with PCS (frequency band: 1820 to 1990 MHz) in the part of the second radiation electrode 4.

Figure 2A:
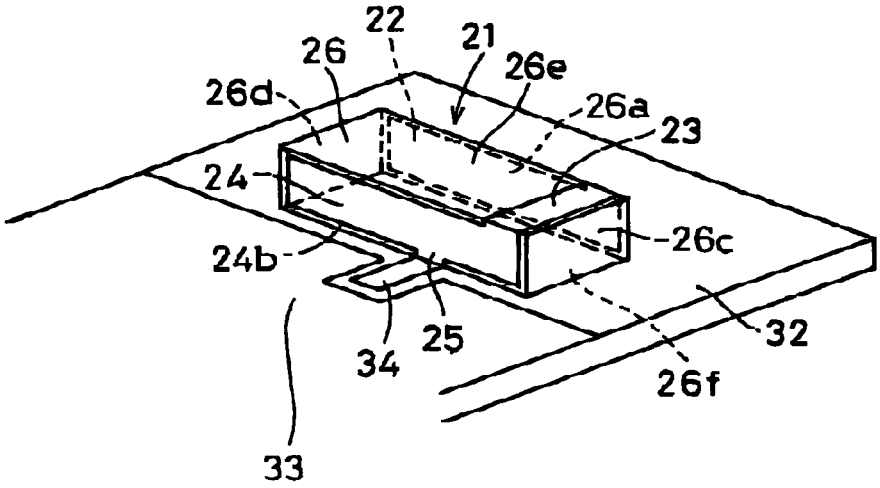
FIG. 2A is a perspective view showing a surface mounting type antenna according to a second embodiment of the invention and an antenna apparatus according to a second embodiment of the invention using the surface mounting type antenna.
Figure 2B:
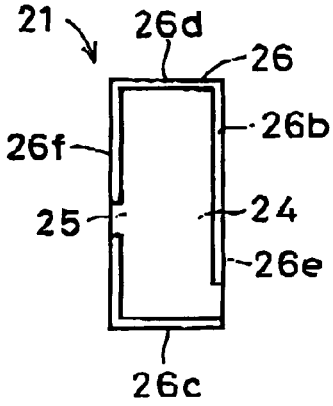
FIG. 2B is a left side view of the surface mounting type antenna shown in FIG. 2A.
Figure 2C:
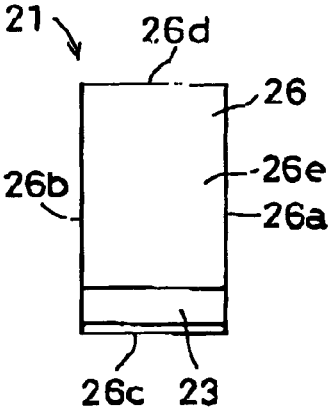
FIG. 2C is a plan view of the surface mounting type antenna shown in FIG. 2A.
Figure 2D:
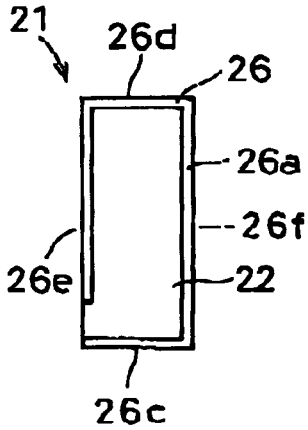
FIG. 2D is a right side view of the surface mounting type antenna shown in FIG. 2A.

FIG. 2A is a perspective view showing a surface mounting type antenna according to a second embodiment of the invention and an antenna apparatus according to a second embodiment of the invention constituted by mounting the surface mounting type antenna on a surface of a mounting substrate. FIG. 2B is a left side view of the surface mounting type antenna shown in FIG. 2A. FIG. 2C is a plan view of the surface mounting type antenna shown in FIG. 2A. FIG. 2D is a right side view of the surface mounting type antenna shown in FIG. 2A.

A surface mounting type antenna 21 according to the second embodiment of the invention includes a base body 26, a first radiation electrode 22, a second radiation electrode 24, a third radiation electrode 23 and a feeder terminal 25. The base body 26 is made of dielectric or magnetic material and is formed in a rectangular parallelepiped shape. The base body 26 includes a first pair of side faces 26*a* and 26*b* opposed to each other, a pair of end faces 26*c* and 26*d* opposed to each other and a second pair of side faces 26*e* and 26*f* opposed to each other. The first radiation electrode 22 is formed on one side face (i.e., a side face on a far side of the base body 26 in FIG. 2A) 26*a* of the first pair of side faces 26*a* and 26*b* so as to extend from one end face 26*c* side to another end face 26*c* side thereof. The second radiation electrode 24 is formed on another side face (i.e., a side face on a near side of the base body 26 in FIG. 2A) 26*b* of the first pair of side faces 26*a* and 26*b* so as to extend from the one end face 26*c* side to the other side face 26*d* side thereof. The third radiation electrode 23 is formed on the one end face (i.e., an end face on a near side of the base body 26 in FIG. 2A) 26*c* side of one side face (i.e., an upper face of the base body 26 in FIG. 2A) 26*e* of the second pair of side faces 26*e* and 26*f*. The third radiation electrode 23 is connected to the first and second radiation electrodes 22 and 23. The feeder terminal 25 is formed on a part of the other side face 26*b* of the first pair of side faces 26*a* and 26*b*. The part is a vicinity of another side face (i.e., a lower face of the base body 26 in FIG. 2A) 26*f* of the second pair of side faces 26*e* and 26*f*. The feeder terminal 25 is connected to the second radiation electrode 24.

In the surface mounting type antenna 21 according to the second embodiment of the invention, on the rectangular parallelepiped base body 26, a group of radiation electrodes 22, 23 and 24 including the radiation electrodes 22, 24 formed on the first pair of side faces 26*a* and 26*b* so as to extend from the one end face 26*c* side to the other end face 26*d* side thereof, and the radiation electrode 23 formed on either one of the one end face 26*c* side and the other end face 26*d* side of the one side face 26*e* of the second pair of side faces 26*e* and 26*f*, the radiation electrode 23 being connected to the radiation electrodes 22 and 24 formed on the first pair of side faces 26*a* and 26*b*, and the feeder terminal 25 formed on a part of either one of the first pair of side faces 26*a* and 26*b*, the part being in a vicinity of the other side face 26*f* of the second pair of side faces 26*e* and 26*f*, the feeder terminal 25 being connected to the radiation electrode 24, are provided.

An antenna apparatus according to the second embodiment of the invention includes the surface mounting type antenna 21 and a mounting substrate 32. On a surface of the mounting substrate 32, a feeder electrode 34 and a ground conductor layer 33 arranged on one side (i.e., a left near side of an upper face of the mounting substrate 32 in FIG. 2A) with respect to the feeder electrode 34 are formed.

The surface mounting type antenna 21 according to the second embodiment of the invention is mounted on this mounting substrate 32 on another side (i.e., a right far side of the upper face of the mounting substrate 32 in FIG. 2A) with respect to the feeder electrode 34 in a state where the other side face (i.e., the lower face of the base body 26 in FIG. 2A) 26*f* of the second pair of side faces 26*e* and 26*f* of the base body 26 faces the surface of the mounting substrate 32, and the feeder terminal 25 is connected to the feeder electrode 34. In this way, the antenna apparatus according to the second embodiment of the invention is constituted.

According to the surface mounting type antenna 21 according to the second embodiment of the invention, a ¼ wavelength monopole antenna coping with a higher frequency f2 of radio signals of two frequency bands used in a communication system is formed by a part of the second radiation electrode 24 formed on the other side face (i.e., the side face on the near side of the base body 26 in FIG. 2A) 26*b* of the first pair of side faces 26*a* and 26*b* of the base body 26 to which the second radiation electrode the feeder terminal 25 is connected. Consequently, the radiation electrode 24 can operate as an antenna coping with the frequency f2. Moreover, a ¼ wavelength monopole antenna coping with a lower frequency f1 of the radio signals of the two frequency bands is formed by a part of the first radiation electrode 22 formed on the one side face (i.e., the side face on the far side of the base body 26 in FIG. 2A) 26*a* of the first pair of side faces 26*a* and 26*b* of the base body 26 which first radiation electrode is connected to the second radiation electrode 24 through the third radiation electrode 23. Consequently, the first radiation electrode 22 can operate also as an antenna coping with the frequency f1. Therefore, according to the surface mounting type antenna 21 according to the second embodiment of the invention and the antenna apparatus according to the second embodiment of the invention using this surface mounting type antenna 21, it is possible to function as an antenna applicable to two frequencies having satisfactory antenna characteristics.

Figure 3A:
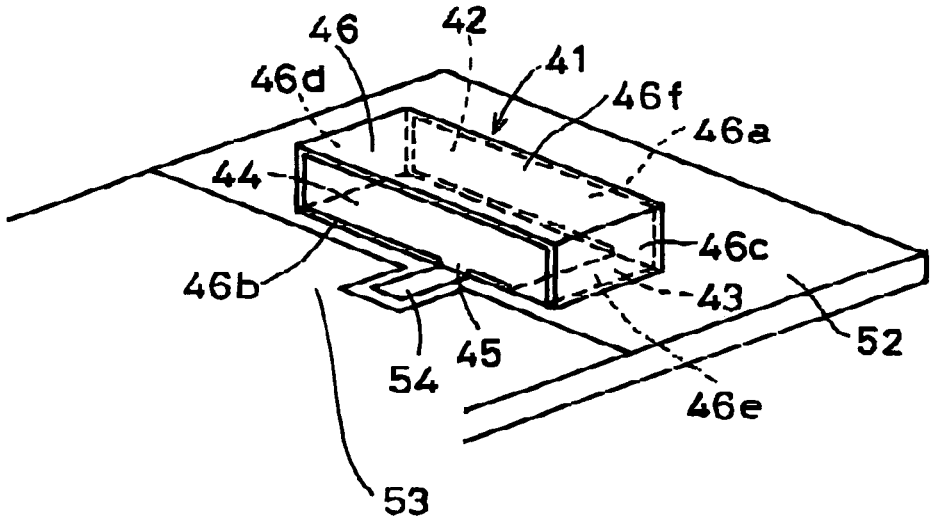
FIG. 3A is a perspective view showing a surface mounting type antenna according to a third embodiment of the invention and an antenna apparatus according to a third embodiment of the invention using the surface mounting type antenna.
Figure 3B:
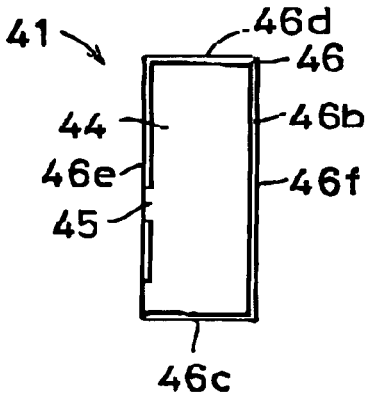
FIG. 3B is a left side view of the surface mounting type antenna shown in FIG. 3A.
Figure 3C:
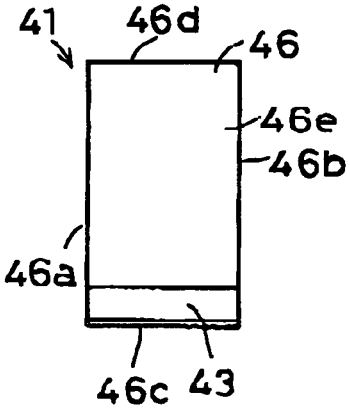
FIG. 3C is a bottom plan view of the surface mounting type antenna shown in FIG. 3A.
Figure 3D:
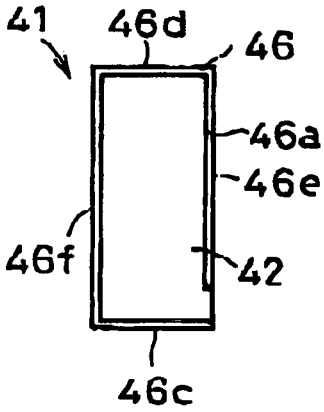
FIG. 3D is a right side view of the surface mounting type antenna shown in FIG. 1A.
Figure 4:
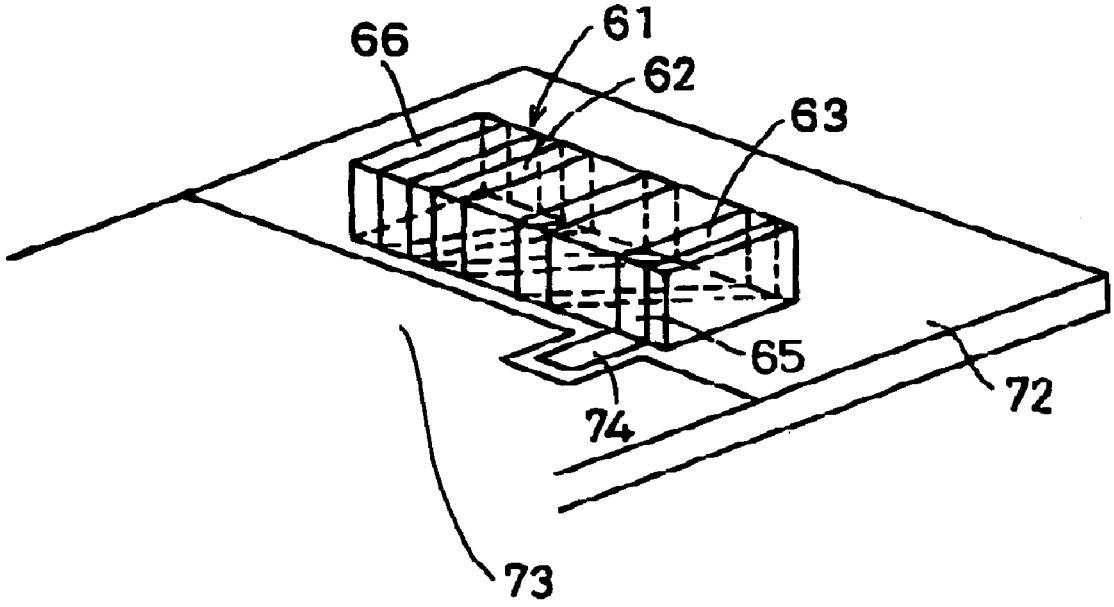
FIG. 4 PRIOR ART
FIG. 4 is a perspective view showing an example of a conventional surface mounting type antenna and an antenna apparatus using the surface mounting type antenna.

FIG. 3A is a perspective view showing a surface mounting type antenna according to a third embodiment of the invention and an antenna apparatus according to a third embodiment of the invention constituted by mounting the surface mounting type antenna on a surface of a mounting substrate. FIG. 3B is a left side view of the surface mounting type antenna shown in FIG. 3A. FIG. 3C is a bottom plan view of the surface mounting type antenna shown in FIG. 3A. FIG. 3D is a right side view of the surface mounting type antenna shown in FIG. 1A.

A surface mounting type antenna 41 according to the third embodiment of the invention includes a base body 46, a first radiation electrode 42, a second radiation electrode 44, a third radiation electrode 43 and a feeder terminal 45. The base body 46 is made of dielectric or magnetic material and is formed in a rectangular parallelepiped shape. The base body 46 includes a first pair of side faces 46*a* and 46*b* opposed to each other, a pair of end faces 46*c* and 46*d* opposed to each other and a second pair of side faces 46*e* and 46*f* opposed to each other. The first radiation electrode 42 is formed on one side face (i.e., a side face on a far side of the base body 46 in FIG. 3A) 46*a* of the first pair of side faces 46*a* and 46*b* so as to extend from one end face 46*c* side to another end face 46*c* side thereof. The second radiation electrode 44 is formed on another side face (i.e., a side face on a near side of the base body 46 in FIG. 3A) 26*b* of the first pair of side faces 46*a* and 46*b* so as to extend from the one end face 46*c* side to the other side face 46*d* side thereof. The third radiation electrode 43 is formed on the one end face (i.e., an end face on a near side of the base body 46 in FIG. 3A) 46*c* side of one side face (i.e., a lower face of the base body 46 in FIG. 3A) 46*e* of the second pair of side faces 46*e* and 46*f*. The third radiation electrode 43 is connected to the first and second radiation electrodes 42 and 43. The feeder terminal 45 is formed on a part of the other side face 46*b* of the first pair of side faces 46*a* and 46*b*. The part is a vicinity of the one side face 46*e* of the second pair of side faces 46*e* and 46*f*. The feeder terminal 45 is connected to the second radiation electrode 44.

In the surface mounting type antenna 41 according to the third embodiment of the invention, on the rectangular parallelepiped base body 46, a group of radiation electrodes 42, 43 and 44 including the radiation electrodes 42, 44 formed on the first pair of side faces 46*a* and 46*b* so as to extend from the one end face 46*c* side to the other end face 46*d* side thereof, and the radiation electrode 43 formed on either one of the one end face 46*c* side and the other end face 46*d* side of the one side face 46*e* of the second pair of side faces 46*e* and 46*f*, the radiation electrode 43 being connected to the radiation electrodes 42 and 44 formed on the first pair of side faces 46*a* and 46*b*, and the feeder terminal 45 formed on a part of either one of the first pair of side faces 46*a* and 46*b*, the part being in a vicinity of the one side face 46*e* of the second pair of side faces 46*e* and 46*f*, the feeder terminal 45 being connected to the radiation electrode 44, are provided.

An antenna apparatus according to the third embodiment of the invention includes the surface mounting type antenna 41 and a mounting substrate 52. On a surface of the mounting substrate 52, a feeder electrode 54 and a ground conductor layer 53 arranged on one side (i.e., a left near side of an upper face of the mounting substrate 52 in FIG. 3A) with respect to the feeder electrode 54 are formed.

The surface mounting type antenna 41 according to the third embodiment of the invention is mounted on this mounting substrate 52 on another side (i.e., a right far side of the upper face of the mounting substrate 32 in FIG. 3A) with respect to the feeder electrode 54 in a state where one side face (i.e., the lower face of the base body 46 in FIG. 3A) 46*c* of the second pair of side faces 46*a* and 46*f* of the base body 46 faces the surface of the mounting substrate 52, and the feeder terminal 45 is connected to the feeder electrode 54. In this way, the antenna apparatus according to the third embodiment of the invention is constituted.

According to the surface mounting type antenna 41 according to the third embodiment of the invention, a ¼ wavelength monopole antenna coping with a higher frequency f2 of radio signals of two frequency bands used in a communication system is formed by a part of the second radiation electrode 44 formed on the other side face (i.e., the side face on the near side of the base body 46 in FIG. 3A) 46*b* of the first pair of side faces 46*a* and 46*b* of the base body 46 to which the second radiation electrode the feeder terminal 45 is connected. Consequently, the radiation electrode 44 can operate as an antenna coping with the frequency f2. Moreover, a ¼ wavelength monopole antenna coping with a lower frequency f1 of the radio signals of the two frequency bands is formed by a part of the first radiation electrode 42 formed on the one side face (i.e., the side face on the far side of the base body 46 in FIG. 3A) 46*a* of the first pair of side faces 46*a* and 46*b* of the base body 46 which first radiation electrode is connected to the second radiation electrode 44 through the third radiation electrode 43. Consequently, the first radiation electrode 42 can operate also as an antenna coping with the frequency f1. Therefore, according to the surface mounting type antenna 41 according to the third embodiment of the invention and the antenna apparatus according to the third embodiment of the invention using this surface mounting type antenna 41, it is possible to function as an antenna applicable to two frequencies having satisfactory antenna characteristics.

In the surface mounting type antennas 1, 21 and 41 of the invention, the base bodies 6, 26 and 46 are made of a rectangular parallelepiped dielectric or magnetic material. The base bodies 6, 26 and 46 are manufactured using, for example, ceramics obtained by subjecting powder, which consists of a dielectric material (relative dielectric constant $\epsilon_r$: 9.6) containing aluminum as a main component, to pressure molding and baking. In addition, a composite material of ceramics and resin, which are dielectric materials, may be used or a magnetic material such as ferrite may be used for the base bodies 6, 26 and 46.

When the base bodies 6, 26 and 46 are made of a dielectric material, a propagation velocity of a high-frequency signal, which propagated through the radiation electrodes 2 to 4, 22 to 24, and 42 to 44, decreases to cause reduction of a wavelength. When a relative dielectric constant of the base bodies 6, 26 and 46 is assumed to be $\epsilon_r$, an effective length of conductor patterns of the radiation electrodes 2 to 4, 22 to 24, and 42 to 44 is increased by $\epsilon_r^{1/2}$ times. Therefore, in the case in which pattern length of the conductor pattern is common, a region of the high electric current density in electric current distribution increases, so that it is possible to increase an amount of radio waves radiated, and it is possible to increase gain of the antenna.

In addition, on the contrary, in the case in which the same characteristics as the conventional antenna characteristics are adopted, it is possible to make the pattern lengths of the radiation electrodes 2 to 4, 22 to 24, and 42 to 44 to be $1/\epsilon_r^{1/2}$, and it is possible to miniaturize the surface mounting type antennas 1, 21 and 41.

Note that, in the case in which the base bodies 6, 26 and 46 are made of a dielectric material, if the relative dielectric constant $\epsilon_r$ is lower than 3, it is close to the relative dielectric constant in the air ($\epsilon_r$=1), and there is a tendency that it is rather difficult to satisfy a market demand for miniaturization of the antenna. In addition, when the relative dielectric constant $\epsilon_r$ is more than 30, the miniaturization is possible, but the gain and bandwidth of the antenna become too small because the gain and bandwidth of the antenna are proportional to the size of the antenna, and there is a tendency that characteristics as an antenna may not be achieved. Therefore, in the case in which the base bodies 6, 26 and 46 are made of a dielectric material, it is desirable to use a dielectric material with the dielectric constant $\epsilon_r$ of 3 or more and 30 or less. Such a dielectric material is, for example, a ceramic material including alumina ceramics and zirconia ceramics, and a resin material including tetrafluoroethylene and glass epoxy.

On the other hand, when the base bodies 6, 26 and 46 are made of a magnetic material, since impedances of the radiation electrodes 2 to 4, 22 to 24, and 42 to 44 increase, it is possible to decrease Q of the antenna and widen the bandwidth.

In the case in which the base bodies 6, 26 and 46 are made of a magnetic substance, when a relative permeability $\mu_z$ is more than 8, the bandwidth of the antenna increases, but the bandwidth of the antenna becomes wide, but the gain and bandwidth of the antenna become too small because the gain and bandwidth of the antenna are proportional to the size of the antenna, so that there is a tendency that characteristics as an antenna may not be achieved. Therefore, in the case in which the base bodies 6, 26 and 46 are made of a magnetic substance, it is desirable to use a magnetic material with the relative permeability $\mu_r$ of 1 or more and 8 or less. Such a magnetic material is, for example, YIG (yttrium iron garnet), an Ni—Zr compound, and an Ni Co—Fe compound.

The radiation electrodes 2 to 4, 22 to 24, and 42 to 44 and the feeder terminals 5, 25 and 45 are formed of metal containing one selected from a group consisting of, for example, aluminum, copper, nickel, silver, palladium, platinum, and gold, as a main component. In order to form respective patterns with such metal, conductor layers of desired pattern shapes only have to be formed on predetermined side faces of the base bodies 6, 26 and 46, respectively, by various thin film forming methods such as printing, deposition, and sputtering, a metal foil lamination method, a plating method, or the like.

A usual circuit substrate of glass epoxy, aluminum ceramics, or the like is used for the mounting substrates 12, 32 and 52.

In addition, the ground conductor layers 13, 33 and 53 and the feeder electrodes 4, 34 and 54 are formed of a conductor such as copper or silver that is used in a usual circuit substrate.

Note that, as a method of mounting the surface mounting type antenna 1, 21 and 41 of the invention on the surface of the mounting substrate 12, 32 and 52 and connecting the feeder terminal 5, 25 and 45 to the feeder electrode 4, 34 and 54, solder mounting by a reflow furnace can be used.

Figure 6A:
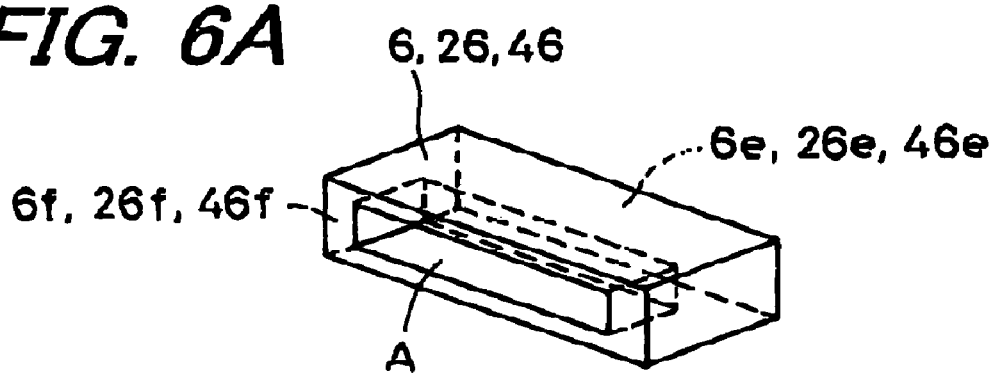
FIGS. 6A and 6B are perspective views showing an example of a base body that is used in the surface mounting type antennas according to the first to third embodiments of the invention.
Figure 6B:
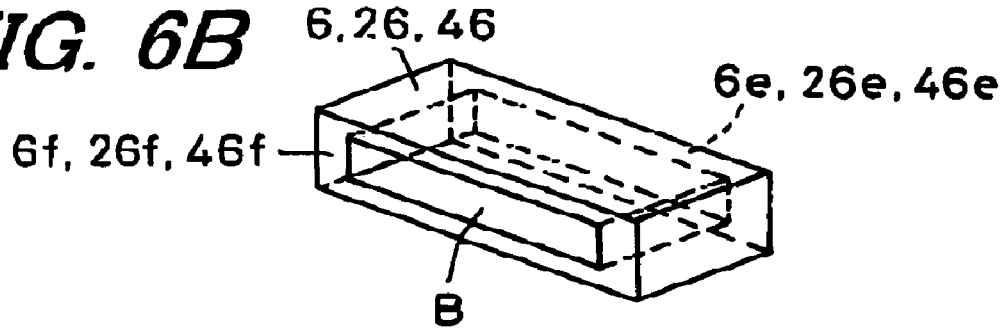

Note that, as shown in the perspective view of the base bodies 6, 26 and 46 in FIGS. 6A and 6B, in the surface mounting type antenna 1, 21 and 41, a recess A or a through hole B is provided extending from the other side face 6*f*, 26*f* and 46*f* toward one side face 6*e*, 26*e* and 46*e* of the second pair of side faces 6*e*, 6*f*; 26*e*, 26*f* and 46*e*, 46*f* of the base bodies 6, 26 and 46. The base body can be reduced in weight and reliability on a mounting strength against an impact after mounting can be improved.

A radio communication apparatus (not shown) of the invention includes the surface mounting type antenna 1, 21 or 41 according to the first to third embodiments of the invention or the antenna apparatus according to the first to third embodiments of the invention as described above, and at least one of the transmission circuit and the reception circuit, which cope with radio signals of different, two frequency bands, connected thereto. In addition, a radio signal processing circuit may be connected to the surface mounting type antenna, the antenna apparatus, the transmission circuit, or the reception circuit in order to make it possible to perform radio communication as desired. Other various structures can be adopted.

According to such a radio communication apparatus of the invention, the radio communication apparatus includes the surface mounting type antenna 1, 21 or 41 of the invention or the antenna apparatus of the invention as described above, and at least one of the transmission circuit and the reception circuit, which cope with radio signals of different two frequency bands, connected thereto. Therefore, the radio communication apparatus can function as a small-sized and high-performance radio communication apparatus applicable to two frequencies.

Figure 7A:
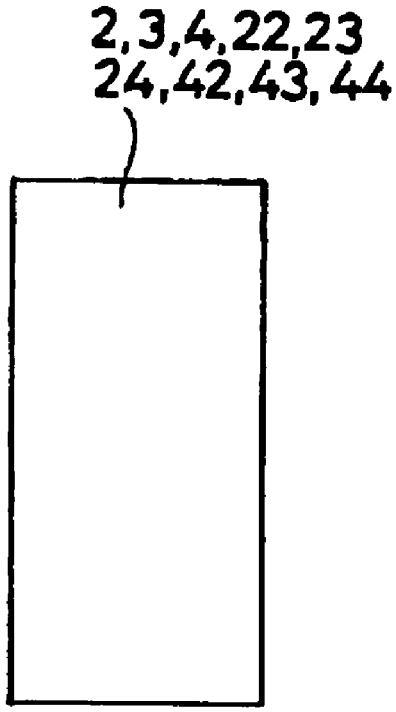
FIGS. 7A and 7B are plan views showing an example of a shape of an radiation electrode used in the surface mounting type antennas according to the first to third embodiments of the invention.
Figure 7B:
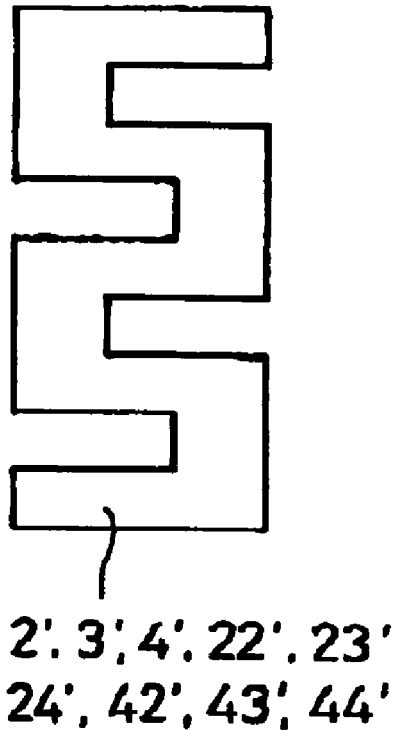

Note that the surface mounting type antenna and the antenna apparatus of the invention are not limited to the above-mentioned embodiments, and various modifications may be applied to the surface mounting type antenna and the antenna apparatus within a range not departing from the scope of the invention. For example, a shape of the radiation electrodes 2, 3, 4, 22, 23, 24, 42, 43 and 44 of the surface mounting type antennas 1, 21 and 41 of the invention is not limited to the rectangular shape as shown in FIG. 7A. Radiation electrodes 2', 3', 4', 22', 23', 24', 42', 43' and 44' of a meander shape as shown in a plan view of FIG. 7B may be adopted. By changing an electrical length in this way, a corresponding frequency can be reduced, or a small sized antenna can be manufactured.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A surface mounting type antenna comprising:

a base body formed in a rectangular parallelepiped shape and made of a dielectric or magnetic material, the base body including a first pair of side faces opposed to each other, a pair of end faces opposed to each other and a second pair of side faces opposed to each other;

a group of radiation electrodes formed on the base body, including radiation electrodes formed on the first pair of side faces so as to extend from one end face side to another end face side thereof, and a radiation electrode formed on either one of the one end face side and the other end face side of one side face of the second pair of side faces, the radiation electrode being connected to the radiation electrodes formed on the first pair of side faces; and a feeder terminal formed on a part of either one of the first pair of side faces, the part being in a vicinity of another side face of the second pair of side faces, the feeder terminal being connected to the group of radiation electrodes.

2. The surface mounting type antenna of claim 1, wherein a recess or a through hole is provided extending from the other side face toward the one side face of the second pair of side faces of the base body.

3. The surface mounting type antenna of claim 1, wherein the base body is made of a dielectric material and a relative dielectric constant thereof $\epsilon_r$ is in a range of 3 to 30.

4. The surface mounting type antenna of claim 1, wherein the base body is made of a magnetic material and a relative permeability thereof $\mu_r$ is in a range of 1 to 8.

5. A surface mounting type antenna comprising:

a base body formed in a rectangular parallelepiped shape and made of a dielectric or magnetic material, the base body including a first pair of side faces opposed to each other, a pair of end faces opposed to each other and a second pair of side faces opposed to each other;

a group of radiation electrodes formed on the base body, including radiation electrodes formed on the first pair of side faces so as to extend from one end face side to another end face side thereof, and a radiation electrode formed on either one of the one end face side and the other end face side of one side face of the second pair of side faces, the radiation electrode being connected to the radiation electrodes formed on the first pair of side faces; and a feeder terminal formed on a part of either one of the first pair of side faces, the part being in a vicinity of the one side face of the second pair of side faces, the feeder terminal being connected to the group of radiation electrodes.

6. The surface mounting type antenna of claim 5, wherein a recess or a through hole is provided extending from the other side face toward the one side face of the second pair of side faces of the base body.

7. The surface mounting type antenna of claim 5, wherein the base body is made of a dielectric material and a relative dielectric constant thereof $\epsilon_r$ is in a range of 3 to 30.

8. The surface mounting type antenna of claim 5, wherein the base body is made of a magnetic material and a relative permeability thereof $\mu_r$ is in a range of 1 to 8.

9. An antenna apparatus comprising:

a mounting substrate on a surface of which a feeder electrode and a ground conductor layer arranged on one side with respect to the feeder electrode are formed; and the surface mounting type antenna of claim 1, wherein the surface mounting type antenna is mounted on another side with respect to the feeder electrode in a state where either one of the first pair of side faces on which the feeder terminal is formed, faces the surface of the mounting substrate, and the feeder terminal is connected to the feeder electrode.

10. An antenna apparatus comprising:

a mounting substrate on a surface of which a feeder electrode and a ground conductor layer arranged on one side with respect to the feeder electrode are formed; and the surface mounting type antenna of claim 2, wherein the surface mounting type antenna is mounted on another side with respect to the feeder electrode in a state where either one of the first pair of side faces on which the feeder terminal is formed, faces the surface of the mounting substrate, and the feeder terminal is connected to the feeder electrode.

11. An antenna apparatus comprising:

a mounting substrate on a surface of which a feeder electrode and a ground conductor layer arranged on one side with respect to the feeder electrode are formed; and the surface mounting type antenna of claim 1, wherein the surface mounting type antenna is mounted on another side with respect to the feeder electrode in a state where the other side face of the second pair of side faces faces the surface of the mounting substrate, and the feeder terminal is connected to the feeder electrode.

12. An antenna apparatus comprising:

a mounting substrate on a surface of which a feeder electrode and a ground conductor layer arranged on one side with respect to the feeder electrode are formed; and the surface mounting type antenna of claim 2, wherein the surface mounting type antenna is mounted on another side with respect to the feeder electrode in a state where the other side face of the second pair of side faces faces the surface of the mounting substrate, and the feeder terminal is connected to the feeder electrode.

13. An antenna apparatus comprising:

a mounting substrate on a surface of which a feeder electrode and a ground conductor layer arranged on one side with respect to the feeder electrode are formed; and the surface mounting type antenna of claim 5, wherein the surface mounting type antenna is mounted on another side with respect to the feeder electrode in a state where the one side face of the second pair of side faces faces the surface of the mounting substrate, and the feeder terminal is connected to the feeder electrode.

14. An antenna apparatus comprising:

a mounting substrate on a surface of which a feeder electrode and a ground conductor layer arranged on one side with respect to the feeder electrode are formed; and the surface mounting type antenna of claim 6, wherein the surface mounting type antenna is mounted on another side with respect to the feeder electrode in a state where the one side face of the second pair of side faces faces the surface of the mounting substrate, and the feeder terminal is connected to the feeder electrode.

15. A radio communication apparatus comprising:

the surface mounting type antenna of claim 1; and at least one of a transmission circuit and a reception circuit, which cope with radio signals of different two frequency bands, connected thereto.

16. A radio communication apparatus comprising:

the surface mounting type antenna of claim 2; and at least one of a transmission circuit and a reception circuit, which cope with radio signals of different two frequency bands, connected thereto.

17. A radio communication apparatus comprising:

the surface mounting type antenna of claim 5; and at least one of a transmission circuit and a reception circuit, which cope with radio signals of different two frequency bands, connected thereto.

18. A radio communication apparatus comprising:

the surface mounting type antenna of claim 6; and at least one of a transmission circuit and a reception circuit, which cope with radio signals of different two frequency bands, connected thereto.

19. A radio communication apparatus comprising:

the antenna apparatus of claim 9; and at least one of a transmission circuit and a reception circuit, which cope with radio signals of different two frequency bands, connected thereto.

20. A radio communication apparatus comprising:

the antenna apparatus of claim 10; and at least one of a transmission circuit and a reception circuit, which cope with radio signals of different two frequency bands, connected thereto.

21. A radio communication apparatus comprising:

the antenna apparatus of claim 11; and at least one of a transmission circuit and a reception circuit, which cope with radio signals of different two frequency bands, connected thereto.

22. A radio communication apparatus comprising:

the antenna apparatus of claim 12; and at least one of a transmission circuit and a reception circuit, which cope with radio signals of different two frequency bands, connected thereto.

23. A radio communication apparatus comprising:

the antenna apparatus of claim 13; and at least one of a transmission circuit and a reception circuit, which cope with radio signals of different two frequency bands, connected thereto.

24. A radio communication apparatus comprising:

the antenna apparatus of claim 14; and at least one of a transmission circuit and a reception circuit, which cope with radio signals of different two frequency bands, connected thereto.

* * * * *